United States Patent [19]

Stenuick

[11] 4,183,415

[45] Jan. 15, 1980

[54] DRILLING APPARATUS

[75] Inventor: Pierre Stenuick, Fontaine l'Eveque, Belgium

[73] Assignee: Stenuick France, Orleans, France

[21] Appl. No.: 962,792

[22] Filed: Nov. 20, 1978

[30] Foreign Application Priority Data

Nov. 21, 1977 [FR] France ..... 77 34849

[51] Int. Cl.[2] ..... E21B 1/06

[52] U.S. Cl. ..... 175/92; 175/171; 175/257; 175/322

[58] Field of Search ..... 175/92, 171, 257, 258, 175/261, 260, 239, 322, 293, 296

[56] References Cited

U.S. PATENT DOCUMENTS

| | | | |
|---|---|---|---|
| 2,754,086 | 7/1956 | Summers | 175/322 |
| 3,230,740 | 1/1966 | Fox | 175/322 X |
| 3,682,260 | 8/1972 | Klemm | 175/257 |
| 3,870,114 | 3/1975 | Pulk | 175/92 |

*Primary Examiner*—William F. Pate, III

*Attorney, Agent, or Firm*—Haseltin, Lake & Waters

[57] ABSTRACT

In apparatus for drilling a hole in the ground comprising tubing for shoring up the walls of the drilled hole and a drilling member comprising a pneumatic percussion hammer having an eccentric cutting edge, the drilling member extending in the tubing and having a working position in which the cutting edge extends below the lower end of the tubing and a removal position in which the cutting edge is within the tubing, the extension tube for supplying gas to the hammer is connected to the hammer by a helicoidal telescopic connection which is rotatable through 180° between retracted and extended positions, a decentring spline being mounted on that part of the telescopic connection connected to the extension tube and arranged so that, in the retracted position of the telescopic connection, assumed when the drilling member is in its working position, the cutting edge is diametrically opposite the spline and, in the extended position of the telescopic connection, assumed when the drilling member is in its removal position, the cutting edge is aligned with the spline.

2 Claims, 4 Drawing Figures

DRILLING APPARATUS

This invention relates to apparatus for drilling holes in the ground, particularly but not exclusively in non-consolidated soil.

In such soil, there may be inconsistent strata of different materials at different depths and they may tend to close in the drilled hole. There may be hard zones at different depths and these require percussion for drilling. The different strata may be wet or even submerged.

To drill holes in such soil, the drilling member which is used often includes a pneumatic percussion hammer at the bottom of the hole, the hammer being provided with a cutting edge. Compressed air is transmitted to the hammer through extension tubes. The walls of the holes are shored up by means of an outside tubing, the outside diameter of which is slightly less than the drilled diameter. This tubing is driven into the hole at the same speed of penetration as the drilling member by a thrust controlled by a controller and with a rotary movement in the opposite direction to that of the drilling member. Together with the drilling member, the outside tubing defines an annular space through which the exhaust air expels the drilling waste to the outside of the hole. To facilitate the removal of the waste, it may be liquefied by means of water injected at the base of the hole via a circuit which is completely independent of the compressed air circuit as far as the bottom end of the hammer.

An eccentric cutting edge is often used to drill a hole of a diameter larger than the outside diameter of the tubing. In some apparatus, the reaction of the eccentric is taken by splines fixed on the tubing. However, the disadvantage of such apparatus is that the passage inside the tubing is not completely free. Once the hole has been drilled it is desirable that the drilling member should be withdrawn but that the tubing should be left for some time so that, for example, linings of a diameter less than the tubing can be inserted into the hole. In such cases it is necessary for the passage inside the tubing to be completely free of obstructions.

In other apparatus, the eccentric part of the cutting edge is movable, the reaction then being taken by the top part of the cutting edge. Apparatus are also proposed in which the reaction of the eccentric is taken by a ring adapted to turn around the shank of the cutting tool. Apparatus of this kind, however, have the disadvantage of increased weight and fragility of the cutting tool.

It is an object of the invention to obviate these disadvantages.

It is an object of the invention to provide apparatus for drilling a hole in the ground comprising:

tubing means for shoring up the walls of the drilled hole;

a drilling member comprising a hammer adapted to be operated by compressed gas and having an eccentric cutting edge, said drilling member extending in said tubing means and being adapted to assume a working position in which said cutting edge extends outside said tubing means and a removal position in which said cutting edge is retracted within said tubing means;

extension tube means for supplying compressed gas to said hammer;

a helicoidal telescopic connection means connecting said extension tube means to said hammer and comprising a first telescopic part connected to said extension tube means and a second telescopic part connected to said hammer, said parts being relatively rotatable through 180° to produce telescopic travel of said telescopic parts between a retracted position and an extended position;

a decentring spline mounted on said first telescopic part and arranged so that in said retracted position of said telescopic connector, which is assumed when said drilling member is in said working position, said eccentric cutting edge is diametrically opposite said spline, and in said extended position of said telescopic connection, which is assumed when said drilling member is moved to said removal position, said eccentric cutting edge is aligned with said spline.

The decentring spline is thus fixed on a part which is independent of the cutting edge and of the tubing. Also, the spline pushes the hammer towards the eccentric part of the cutting edge, thus reinforcing its eccentricity.

In a preferred embodiment, the cutting edge striking surface is inclined with respect to the hammer striking axis, so that the cutting edge tends to "slide" towards the exterior and thus reinforces its eccentricity.

The invention will now be described in greater detail with reference to a preferred embodiment of the invention given by way of example only and illustrated in the accompanying drawings.

Figure 1:
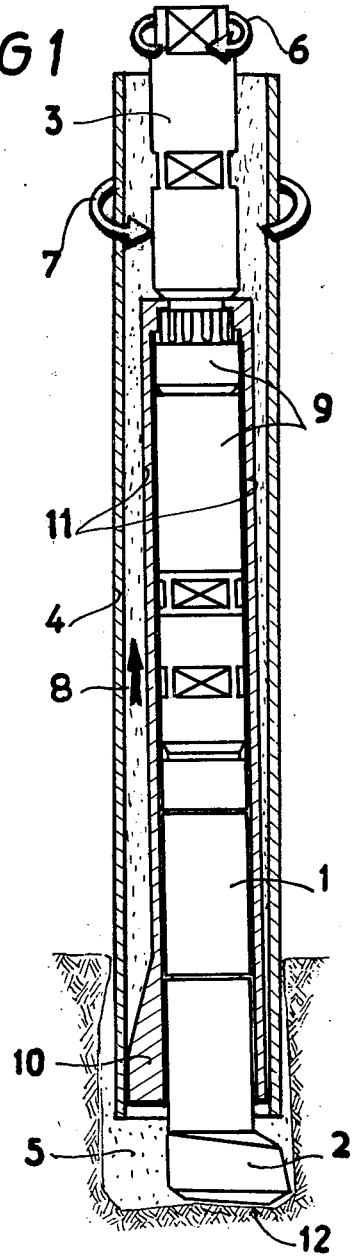
FIG. 1 is a part sectional part side view of an embodiment according to the invention, the telescopic connection being in the retracted position corresponding to the working position of the hammer.

The drilling apparatus shown in the drawings comprises a drilling member comprising a pneumatic percussion hammer 1 having a cutting edge 2. The hammer 1 is operated by compressed air fed to it by extension tubes 3.

The walls of the drilled hole 5 are shored by an outer tubing 4 which is driven into the hole 5 at the same speed of penetration as the drilling member by a thrust controlled by a device (not shown), and with a rotary movement in the opposite direction to the direction of rotation of the drilling member. Arrows 6 and 7 show the direction of rotary movement of the drilling member and of the tubing 4 respectively. Separate motors (not shown) may be provided for the two movements or one motor (not shown) with two concentric output shafts rotating in opposite directions.

Together with the drilling member, the tubing 4 defines a space through which the exhaust air expels the drilling waste or sediments as shown by arrow 8.

The outside diameter of the tubing 4 is less than the diameter of the drilled hole, the cutting edge 2 being eccentric.

The extension tubes 3 are connected to the hammer 1 by helicoidal telescopic connection 9 which comprises a first part connected to tubes 3 and a second part connected to hammer 1. A spline 10, by means of which the hammer and cutting edge assembly is decentred with respect to the tubing 4, is fixed on a tube 11 which fits over the hammer 1. The tube 11 bearing the spline is fixed to the first part of the connection 9 which is connected to the extension tubes 3.

Figure 3:
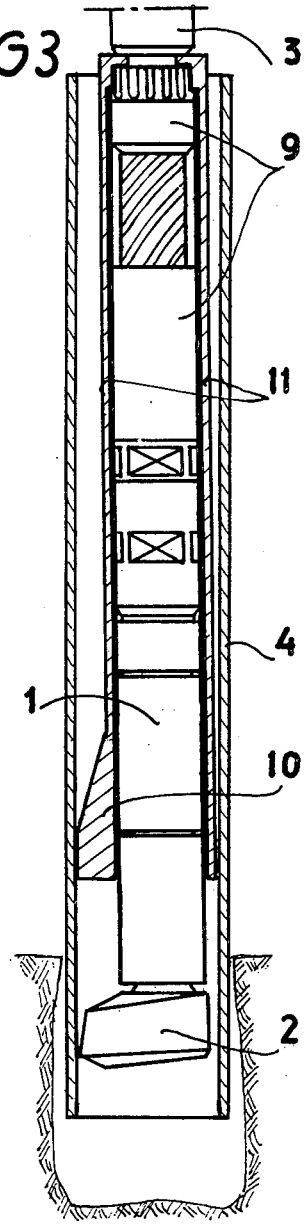
FIG. 3 is a view similar to that of FIG. 1 showing the telescopic connection in its extended position corresponding to withdrawal of the drilling member.
Figure 2:
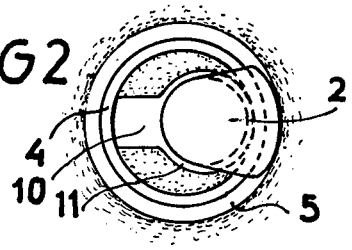
FIG. 2 is an underneath plan view of the apparatus shown in FIG. 1.
Figure 4:
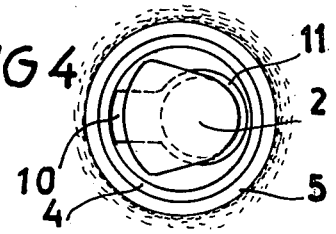
FIG. 4 is an underneath plan view of the apparatus shown in FIG. 3.

The telescopic travel of the connection is provided by a relative 180° rotation of the parts so that when the connection is in the retracted position, which it assumes when the drilling member is moved to its working position (FIG. 1), the eccentric part of the cutting edge 2 is diametrically opposite the spline 10, while, when the connection is in the extended position which it assumes when the drilling member is to be moved to its removed position (FIG. 3), the eccentric part of the cutting edge 2 is axially aligned with and is situated beneath the spline 10.

During drilling, therefore, the hammer with its cutting edge is decentred with respect to the tubing 4 by means of the spline 10. The latter pushes the hammer towards the eccentric part of the cutting edge 2, thus reinforcing its eccentricity. Also, the striking surface 12 of the cutting edge is inclined with respect to the striking axis of the hammer, thus further reinforcing the eccentricity of the cutting edge 2.

The above-described system does not increase the weight or the fragility of the cutting edge as in some prior apparatus. Also, the above described apparatus allows a completely free passage to be provided inside the tubing 4.

Of course the invention is not strictly limited to the embodiment described by way of example only, but covers other embodiments differing therefrom only in constructional alternatives or the use of equivalent means.

In particular, the invention is applicable to more sophisticated drilling facilities, e.g. those which have a circuit for the injection of fluid at the bottom of the hole completely independent of the compressed air circuit, the object of the fluid being to facilitate removal of the drilling sediment.

What is claimed:

1. Apparatus for drilling a hole in the ground comprising:

tubing means for shoring up the walls of the drilled hole;

a drilling member comprising a hammer adapted to be operated by compressed gas and having an eccentric cutting edge, said drilling member extending in said tubing means and being adapted to assume a working position in which said cutting edge extends outside said tubing means and a removal position in which said cutting edge is retracted within said tubing means;

extension tube means for supplying compressed gas to said hammer;

a helicoidal telescopic connection means connecting said extension tube means to said hammer and comprising a first telescopic part connected to said extension tube means and a second telescopic part connected to said hammer, said parts being relatively rotatable through 180° to produce telescopic travel of said telescopic parts between a retracted position and an extended position;

a decentring spline mounted on said first telescopic part and arranged so that in said retracted position of said telescopic connector, which is assumed when said drilling member is in said working position, said eccentric cutting edge is diametrically opposite said spline, and in said extended position of said telescopic connection, which is assumed when said drilling member is moved to said removal position, said eccentric cutting edge is aligned with said spline.

2. Apparatus according to claim 1, wherein said cutting edge has a striking surface which is inclined with respect to the axis of said hammer.

* * * * *